US012616270B2

(12) United States Patent
Cruz

(10) Patent No.: US 12,616,270 B2
(45) Date of Patent: May 5, 2026

(54) FOOTWEAR HAVING AN INTEGRAL HEATER

(71) Applicant: Victor Cruz, Bartlett, TN (US)

(72) Inventor: Victor Cruz, Bartlett, TN (US)

(73) Assignee: Victor Cruz, Waterford, CT (US)

( * ) Notice: Subject to any disclaimer, the term of this patent is extended or adjusted under 35 U.S.C. 154(b) by 0 days.

(21) Appl. No.: 18/784,451

(22) Filed: Jul. 25, 2024

(65) Prior Publication Data

US 2025/0031800 A1 Jan. 30, 2025

Related U.S. Application Data

(60) Provisional application No. 63/529,188, filed on Jul. 27, 2023.

(51) Int. Cl.
*A43B 3/35* (2022.01)
*A43B 3/00* (2022.01)

(52) U.S. Cl.
CPC ..... *A43B 3/35* (2022.01); *A43B 3/0031* (2013.01)

(58) Field of Classification Search
CPC ..... A43B 3/35; A43B 3/0031; A43B 3/355
USPC ..... 36/2.6
See application file for complete search history.

(56) References Cited

U.S. PATENT DOCUMENTS

| | | | | |
|---|---|---|---|---|
| 5,623,772 | A * | 4/1997 | Sunderland | A43B 3/0031 36/2.6 |
| 9,572,397 | B2 * | 2/2017 | Zsolcsak | A43B 13/38 |
| 2009/0013554 | A1 * | 1/2009 | Macher | A43B 3/0031 36/43 |
| 2011/0083339 | A1 * | 4/2011 | Luo | A43B 3/35 36/2.6 |
| 2014/0000130 | A1 * | 1/2014 | Crist | A61F 7/00 36/136 |

* cited by examiner

*Primary Examiner* — Timothy K Trieu
(74) *Attorney, Agent, or Firm* — Mccarter & English LLP, Boston; Dave Christensen

(57) ABSTRACT

A shoe and a shoe heating system is provided. In one embodiment, the shoe includes an upper and a sole. A first pocket is disposed in one of the upper or the sole, the first pocket being configured and arranged to receive a first heating packet. In another embodiment, the shoe heating system is provided having a battery disposed in a shoe. An integral heating element is arranged integral to the shoe, the integral heating element receiving electric power from the battery and generating heat within the shoe.

8 Claims, 3 Drawing Sheets

FOOTWEAR HAVING AN INTEGRAL HEATER

CROSS-REFERENCE TO RELATED APPLICATIONS

The present application is a nonprovisional application of, and claims the benefit of, U.S. Provisional Application Ser. No. 63/529,188 file Jul. 27, 2023, the contents of which are incorporated by reference herein.

BACKGROUND OF THE DISCLOSURE

The subject matter disclosed herein relates to a footwear.

Footwear, also referred to as shoes, come in many different types and can be used for various activities, such as walking, sports, working, leisure, and/or the like including combinations and/or multiples thereof. One purpose of footwear is to protect the wearer's feet from environmental elements, such as rain, sun, snow, cold, heat, and/or the like including combinations and/or multiples thereof. Yet another purpose of footwear is to provide comfort to the wearer.

While existing footwear is suitable for its intended purposes, the need for improvement remains, particularly in providing improved protection and comfort to wearers.

BRIEF DESCRIPTION OF THE DISCLOSURE

According to one aspect of the disclosure a shoe is provided. The shoe includes an upper and a sole. A first pocket is disposed in one of the upper or the sole, the first pocket being configured and arranged to receive a first heating packet.

According to another aspect of the disclosure a shoe heating system is provided. The system having a battery disposed in a shoe. An integral heating element is arranged integral to the shoe, the integral heating element receiving electric power from the battery and generating heat within the shoe.

These and other advantages and features will become more apparent from the following description taken in conjunction with the drawings.

BRIEF DESCRIPTION OF DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION OF THE DISCLOSURE

Embodiments described herein provide for footwear having heating properties according to one or more embodiments described herein. As examples, a shoe can include heating packets, a thermal lining, integral heating elements and/or the like including combinations and/or multiples thereof. A shoe having one or more of the heating properties described herein provide improved comfort for a wearer and improved protection for the user. For example, a wearer's feet can be warmed, thereby improving the wearer's comfort and protection from the cold.

Figure 1:
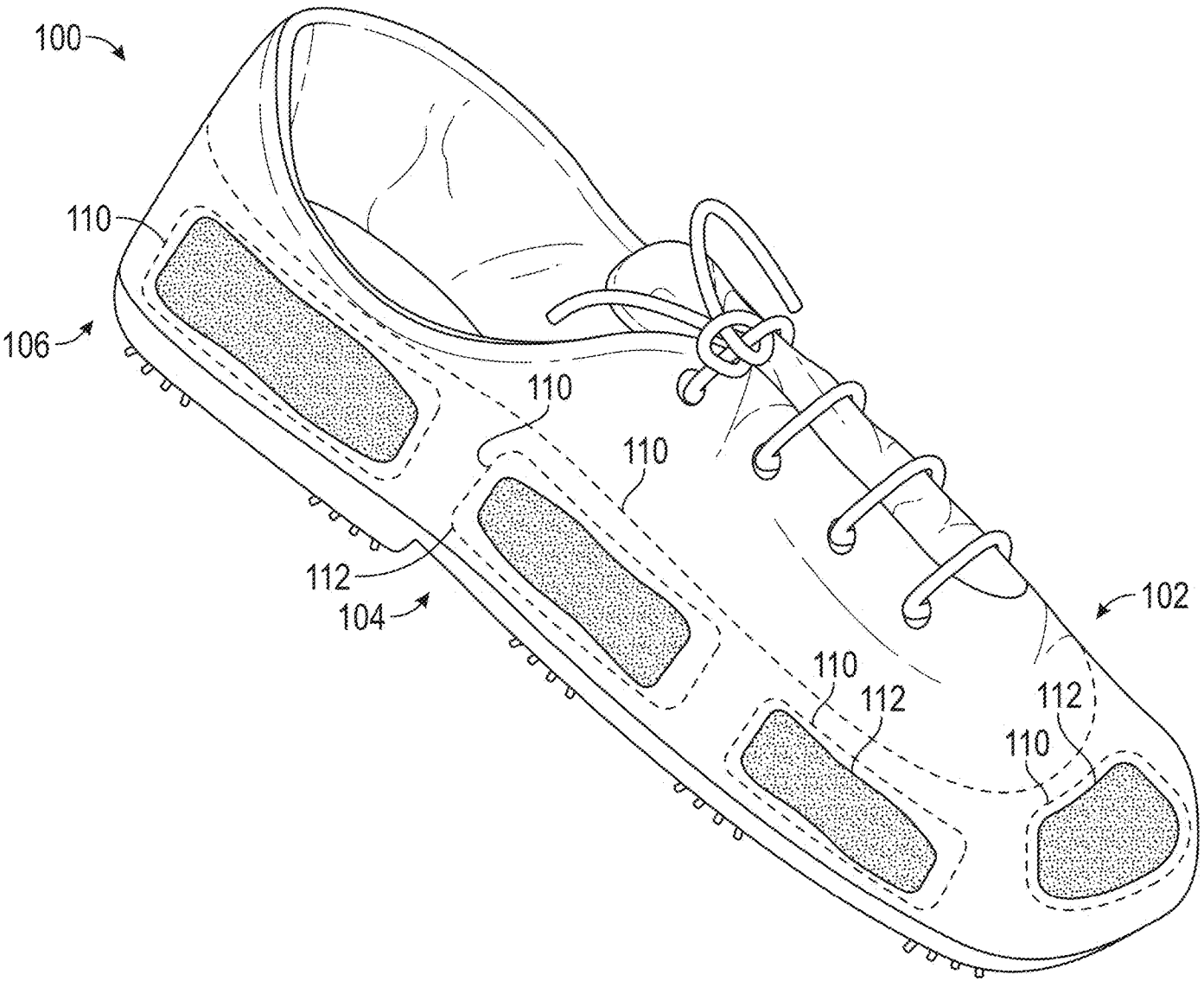
FIG. 1 is a representation of a shoe having heating packets according to one or more embodiments described herein.

Referring now to FIG. 1, shoe 100 is shown according to one or more embodiments described herein. In this example, the shoe 100 includes pockets 110 arranged at various positions on the shoe, such in an upper 102 of the shoe 100, a sole 104 of the shoe 100, and/or a heel 106 of the shoe 100. For example, the pockets 110 can include various pockets arranged around the shoe 100 to receive heating packets 112. As an example, a first pocket can be arranged in the upper 102, a second pocket can be arranged in the sole 104, and a third pocket can be arranged in the heel 106. In an example, each of the upper 102, the sole 104, and the heel 106 can include one or more pockets. Other configurations and arrangement of pockets 110 are also possible.

The heating packets 112 are configured to generate heat, thereby providing warmth to the wearer. As an example, the heating packets 112 can be chemical heating packets that generate heat by chemical reaction. For example, the packets may contain a mixture of iron, water, activated carbon, vermiculite, cellulose and salt for example. Once the packet is exposed to air, the iron oxidizes and releases thermal-energy/heat in the process. In other embodiments, the heating packets 112 may be made from a reusable material, such as sodium-acetate dissolved in water. Reusable heating packets may be heated using a suitable device, such as a microwave oven for example.

The pockets 110 and the associated heating packets 112 may be disposed about the periphery of the body of the shoe, such as along the tongue, throat, throatline, quarter or heel cap/counter portions of the shoe. In further embodiments, at least one pocket 110 and heating packet 112 are positioned on the toe box of the shoe. In one or more embodiments, there may be at least one pocket 110 and heating packet 112 disposed in the sole/outsole of the shoe.

As another example, the heating packets can be electric heating packets that generate heat using electric power, such as but not limited to a resistance heating element (e.g. wire heating element) for example. In this embodiment, the shoe 100 may include a power source, such as a battery for example. It should be appreciated that other types of heating elements are also possible.

The heating packets 112 can be removable and insertable by the wearer. For example, one or more of the heating packets 112 can be removed to be reheated, recharged, or replaced. The wearer can then re-insert the heating packets 112 and/or insert new heating packets 112.

The shoe 100 can be any suitable type of footwear, such as walking shoes, hiking shoes, running shoes, golfing shoes, biking shoes, soccer shoes, basketball shoes, football shoes, and/or the like.

Figure 2:
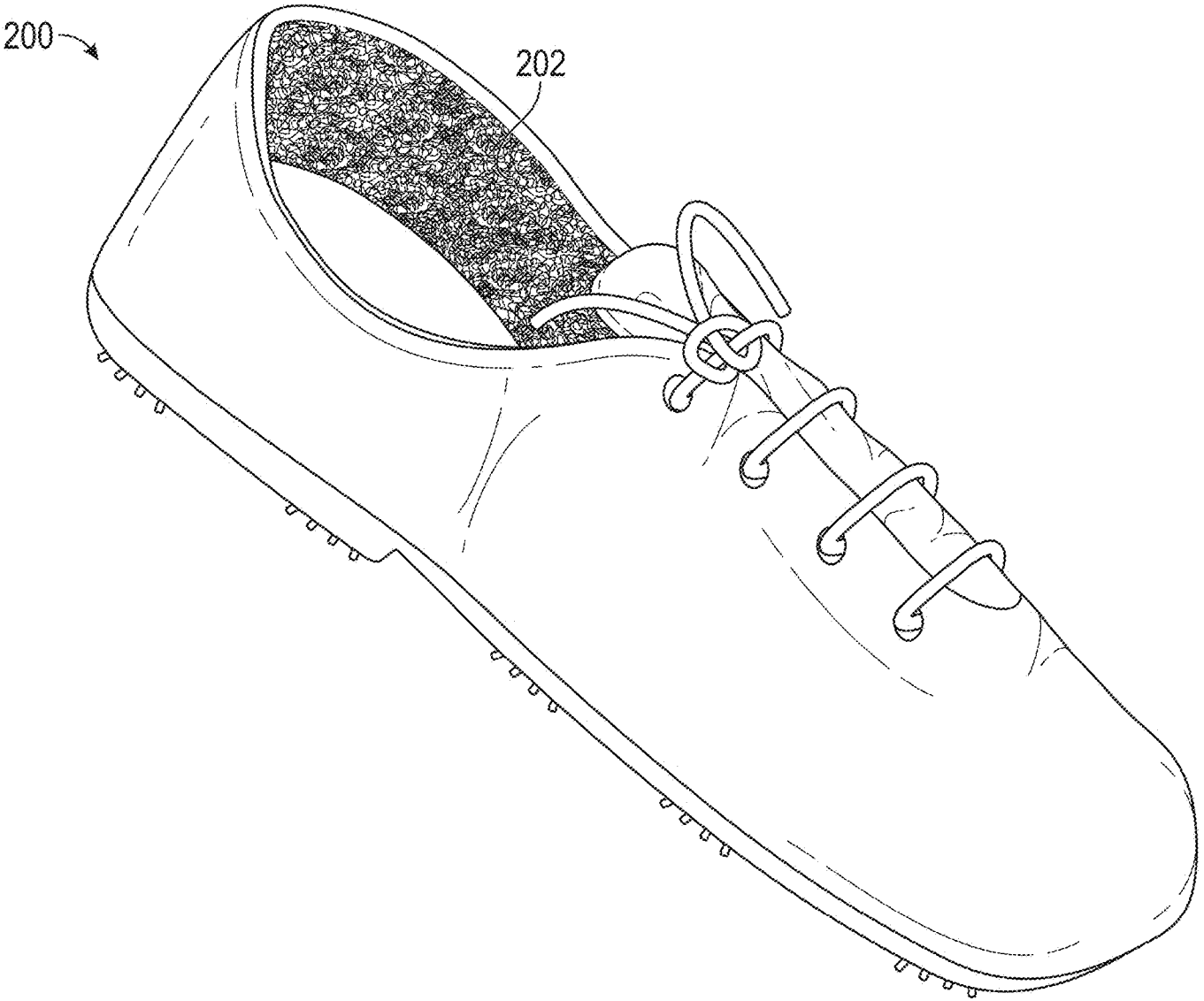
FIG. 2 is a representation of a shoe having a thermal lining according to one or more embodiments described herein.

Turning now to FIG. 2, a shoe 200 is shown according to one or more embodiments described herein. In this example, the shoe 200 includes a thermal lining 202 that can be disposed in the shoe 100 as a liner. The thermal lining 202 can be arranged on any interior portion of the shoe 200. According to one or more embodiments described herein, the thermal lining 202 can be a fur or faux-fur material. Other examples of insulating materials can also be used as the thermal lining 202.

It should be appreciated that the thermal lining 202 of the shoe 200 of FIG. 2 can be used in conjunction with the heating packets 112 and pockets 110 embodiment of the shoe 100 of FIG. 1. For example, the shoe 100, which includes the heating packets 112 disposed in pockets 110, can also include the thermal lining 202. This arrangement further provides warmth to the wearer of the shoe 200.

The shoe 200 can be any suitable type of footwear, such as walking shoes, hiking shoes, running shoes, golfing shoes, biking shoes, soccer shoes, basketball shoes, football shoes, and/or the like.

Figure 3:
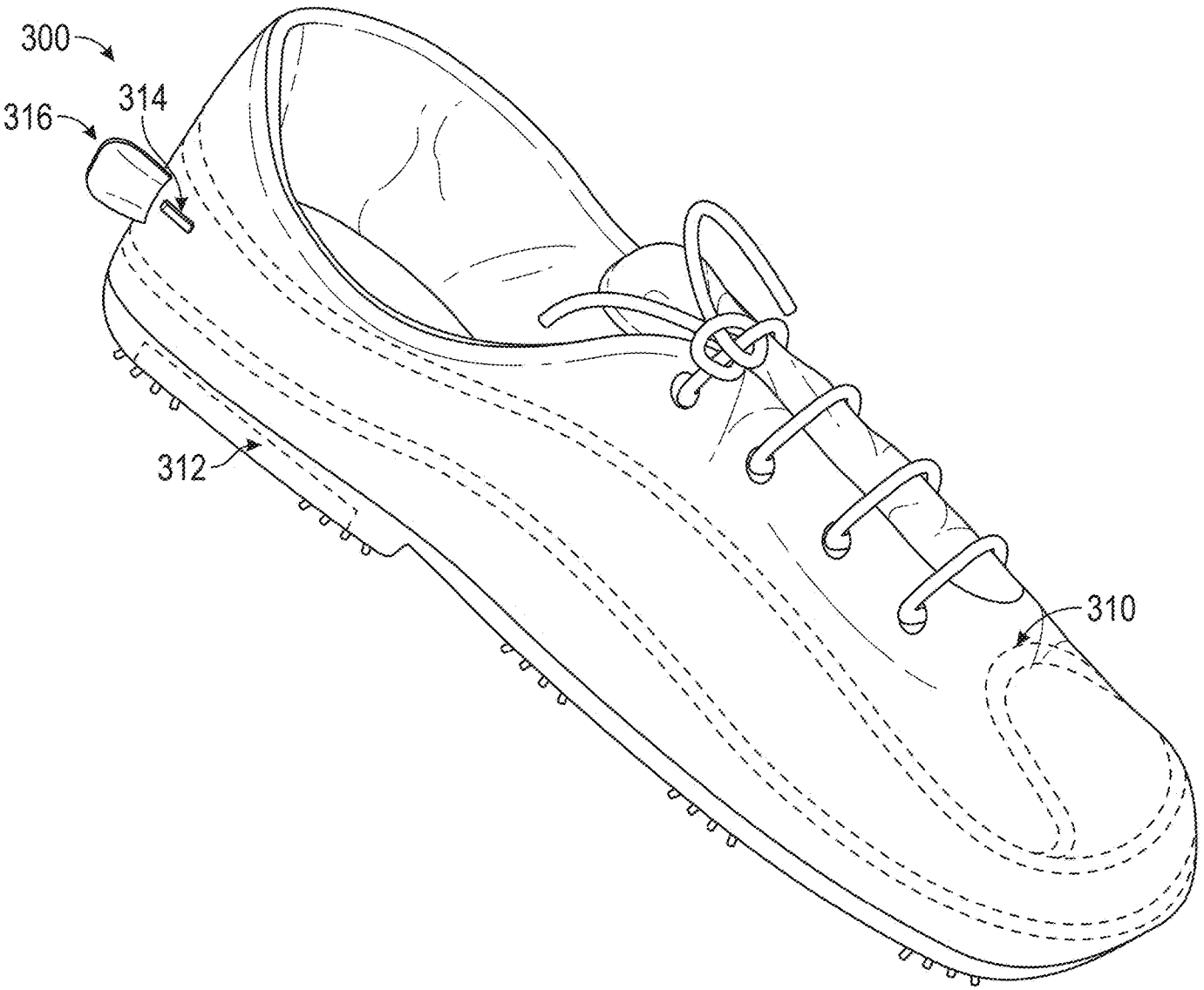
FIG. 3 is a representation of a shoe having an integral heating element according to one or more embodiments described herein.

Turning now to FIG. 3, a shoe 300 is shown according to one or more embodiments described herein. In this example, the shoe 300 includes an integral heating element 310. The integral heating element 310 can be wires configured and arranged between layers of material forming the shoe 300. For example, wires can be configured and arranged throughout the shoe 300 to provide heat to the wearer of the shoe 300. The wires forming the integral heating element 310 can be electrically connected to a battery 312 for providing electric power to integral heating element 310. When current flows through the integral heating element 310 from the battery 312, heat is generated within the shoe, thereby providing warmth to the wearer of the shoe 300.

The battery 312 can be a thin profile battery, for example. The battery 312 produces power to generate heat in the wires forming the integral heating element 310. The battery 312 can be integral to the shoe 300. In an embodiment, the battery 312 is located in the heel portion of the shoe generally parallel with the bottom surface of the heel. The battery 312 can be recharged. According to one or more embodiments described herein, the battery 312 is recharged by connecting a charging device (not shown) to a charging port 314 of the shoe 300. In an embodiment, the charging port 312 is located in the heel cap, counter or backstay portion of the shoe. The charging port 314 can have a cover 316 to protect the charging port 314. According to one or more embodiments described herein, the battery 312 is removable from the shoe 300 and can be removed to be recharged external to the shoe 300 and/or replaced with a new battery. According to one or more embodiments described herein, the shoe 300 can include multiple integral heating elements 310. Each of the multiple integral heating elements 310 can be electrically connected to the battery 312 and/or to additional batteries (not shown).

The heating elements 310 may generate thermal energy through electrical resistance, such as through a wire for example. The heating element 310 may be disposed about the periphery of the shoe body and include portions that extend onto the top of the toe box, the throat, and/or the tongue of the shoe.

It should be appreciated that the thermal lining 202 of the shoe 200 of FIG. 2 can be used in conjunction with the integral heating element 310 embodiment of the shoe 300 of FIG. 3. For example, the shoe 300, which includes the integral heating element 310, can also include the thermal lining 202. This arrangement further provides warmth to the wearer of the shoe 200.

The shoe 300 can be any suitable type of footwear, such as walking shoes, hiking shoes, running shoes, golfing shoes, biking shoes, soccer shoes, basketball shoes, football shoes, and/or the like.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It should also be noted that the terms "first", "second", "third", "upper", "lower", and the like may be used herein to modify various elements. These modifiers do not imply a spatial, sequential, or hierarchical order to the modified elements unless specifically stated.

Various embodiments are described herein with reference to the related drawings. Alternative embodiments can be devised without departing from the scope described herein. Various connections and positional relationships (e.g., over, below, adjacent, etc.) are set forth between elements in the following description and in the drawings. These connections and/or positional relationships, unless specified otherwise, can be direct or indirect, and the embodiments described herein are not intended to be limiting in this respect. Accordingly, a coupling of entities can refer to either a direct or an indirect coupling, and a positional relationship between entities can be a direct or indirect positional relationship. Moreover, the various tasks and process steps described herein can be incorporated into a more comprehensive procedure or process having additional steps or functionality not described in detail herein.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" may be understood to include any integer number greater than or equal to one, i.e. one, two, three, four, etc. The terms "a plurality" may be understood to include any integer number greater than or equal to two, i.e. two, three, four, five, etc. The term "connection" may include both an indirect "connection" and a direct "connection."

The terms "about," "substantially," "approximately," and variations thereof, are intended to include the degree of error associated with measurement of the particular quantity based upon the equipment available at the time of filing the application. For example, "about" can include a range of ±8% or 5%, or 2% of a given value.

For the sake of brevity, conventional techniques related to making and using one or more of the embodiments described herein may or may not be described in detail herein. In particular, various aspects of computing systems and specific computer programs to implement the various technical features described herein are well known. Accordingly, in the interest of brevity, many conventional implementation details are only mentioned briefly herein or are omitted entirely without providing the well-known system and/or process details.

The descriptions of the various embodiments have been presented for purposes of illustration, but are not intended to be exhaustive or limited to the embodiments disclosed. Many modifications and variations will be apparent to those of ordinary skill in the art without departing from the scope of the described embodiments. The terminology used herein was chosen to best explain the principles of the embodiments, the practical application or technical improvement over technologies found in the marketplace, or to enable others of ordinary skill in the art to understand the embodiments described herein.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A shoe heating system of a shoe, the shoe having a heal portion and a body having an upper portion, the shoe heating system comprising: a battery disposed in a heel portion of the shoe; an integral heating element integral to the shoe, the integral heating element electrically coupled to receive electric power from the battery and generating heat within the shoe; and wherein the integral heating element is disposed in at least both an upper portion of the shoe and the sole of the shoe; wherein the heating element is disposed about the periphery of the shoe body; wherein extend onto a top of a toe box, a throat, and a tongue of the shoe.

2. The shoe heating system of claim 1, further comprising a charging port disposed in the shoe and being electrically connected to the battery, the charging port connectable to a charging device to charge the battery.

3. The shoe heating system of claim 2, further comprising a cover configured and arranged to cover the charging port when the charging device is not connected to the charging port.

4. The shoe heating system of claim 2, wherein the integral heating element is a wire.

5. The shoe heating system of claim 1, wherein the battery is integral to the shoe.

6. The shoe heating system of claim 1, wherein the battery is removable from the shoe.

7. The shoe heating system of claim 1, wherein the battery is rechargeable.

8. The shoe heating system of claim 1, wherein the shoe further comprises a thermal lining.

* * * * *